US009392366B1

(12) United States Patent
Meyer et al.

(10) Patent No.: US 9,392,366 B1
(45) Date of Patent: Jul. 12, 2016

(54) MAGNITUDE AND PHASE CORRECTION OF A HEARING DEVICE

(71) Applicant: Meyer Sound Laboratories, Incorporated, Berkeley, CA (US)

(72) Inventors: John D. Meyer, Berkeley, CA (US); Toban A. Szuts, El Cerrito, CA (US); Perrin Meyer, Albany, CA (US); Roger Schwenke, Alameda, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 53 days.

(21) Appl. No.: 14/552,362

(22) Filed: Nov. 24, 2014

Related U.S. Application Data

(60) Provisional application No. 61/908,668, filed on Nov. 25, 2013.

(51) Int. Cl.
*H04R 3/04* (2006.01)
*H04R 1/10* (2006.01)

(52) U.S. Cl.
CPC ..... *H04R 3/04* (2013.01); *H04R 1/1016* (2013.01)

(58) Field of Classification Search
None
See application file for complete search history.

(56) References Cited

U.S. PATENT DOCUMENTS

| | | | | |
|---|---|---|---|---|
| 5,325,436 | A | 6/1994 | Soli et al. | |
| 5,903,655 | A | 5/1999 | Salmi et al. | |
| 8,213,653 | B2 | 7/2012 | Von Buol et al. | |
| 8,385,864 | B2 * | 2/2013 | Dickson | H03H 21/0012 375/350 |
| 2007/0118367 | A1 * | 5/2007 | Dickson | G10L 19/0204 704/221 |
| 2012/0008791 | A1 * | 1/2012 | Gerkmann | H04R 25/505 381/23.1 |

* cited by examiner

*Primary Examiner* — Brenda Bernardi
(74) *Attorney, Agent, or Firm* — Beeson Skinner Beverly, LLP

(57) ABSTRACT

A method for correcting magnitude and phase distortion in open ear hearing devices includes determining the insertion effect of the hearing device substantially at the ear drum when in the ear. Both the magnitude and phase response of the complex insertion transfer function (ITF) are corrected when the transfer function to the ear drum substantially matches the transfer function without the hearing device in place.

27 Claims, 4 Drawing Sheets

MAGNITUDE AND PHASE CORRECTION OF A HEARING DEVICE

CROSS-REFERENCE TO RELATED APPLICATIONS

This application claims the benefit of U.S. Provisional Application No. 61/908,668, filed Nov. 25, 2014, which is incorporated herein by reference.

BACKGROUND

The present invention generally relates to hearing devices worn by a person to improve the person's ability to hear sounds. Reference will sometimes be made herein to "hearing aids;" however, such references are not intended to limit the invention to use by persons having hearing loss. The invention could as well be used by persons without hearing impairments.

The invention more particularly relates to hearing devices wherein at least a portion of the device occludes the ear canal and creates undesirable insertion effects. The invention has particular applicability to open ear hearing devices, but could also be used in conjunction with closed ear devices.

Inserting all or a portion of a hearing aid into the ear distorts both the magnitude and phase of the sound arriving at the ear drum. Ideally, the hearing device will compensate for these effects so that the arriving sound remains undistorted after passing through the hearing device and ear canal. Many hearing aid devices compensate for the magnitude effects, but fail to adequately address phase distortion. The result is that users often complain that the sound is not natural and lacks directional cues important to the listening experience. Such complaints are particularly prevalent among musicians and professionals in the music industry, whose ears are trained to distinguish subtle differences but who require hearing aids to compensate for a partial loss of hearing.

One proposed solution of compensating for the insertion effect of hearing aids is described in U.S. Pat. No. 5,325,436 to Sigfrid Soli, et al. The Soli patent discloses a method of determining a digital filter that compensates for the insertion effects of an in-ear hearing aid. In Soli the magnitude and phase response in the ear is measured both without the hearing aid and with the hearing aid in place. The required equalization (EQ) is then calculated. In doing so, Soli makes assumptions regarding the phase component that in most cases are not valid. The method described by Soli is complicated, requires that the EQ be calculated, and due to the assumptions made about phase is likely to be ineffective. Soli pre-supposes an ear piece that fully occludes the ear canal so as to attenuate all outside sounds. Also, the correction described in Soli is intended only to preserve the interaural timing difference between the ears, not the absolute timing difference: because of this, Soli requires binaural fittings of the hearing aids.

The present invention provides a device and method for correcting the insertion effect of a hearing device in an ear, which requires no assumptions about the phase response, can be used with monaural fittings, and is suited for open ear inserts. The invention is particularly effective in correcting, at the ear drum, phase distortion and anomalies in sound caused by the presence of the hearing device in the ear canal. The device and method of the invention are capable of providing, to the ear drum, amplified sound that is perceived as natural and which retains directional cues for an improved listening experience; that is, the device is perceived to be acoustically transparent. Improvements to the listening experience will be realized by most users, but will be realized in particular by music industry professionals who wish to regain their capability to discern subtle musical differences.

SUMMARY OF INVENTION

The invention is directed to a method and device for correcting magnitude and phase distortion in hearing devices wherein at least a portion of the hearing device is inserted in the ear when worn by the user. The method comprises determining the insertion effect of the hearing device when in the ear of a user. The insertion effect is characterized by a complex insertion transfer function (ITF) having a magnitude and a phase response and is determined at the ear drum. Both the magnitude and phase response of the ITF is corrected when the transfer function to the ear drum matches the transfer function without the hearing device in place.

Preferably, the insertion effect is corrected by at least one and suitably a plurality $2^{nd}$ order minimum phase filters. The $2^{nd}$ order minimum phase filters are preferably infinite impulse response (IIR) filters, and still more preferably biquad filters.

Correcting for the insertion effect in both magnitude and phase involves determining an appropriate equalization, which can roughly but not entirely be determined by taking the ratio of a complex head-related transfer function (HRTF) and a complex insertion transfer function (ITF). The complex HRTF and ITF can be determined by measurements on a manikin with and without the hearing device, or can be determined by measurements directly on the user of the hearing device. The phase response is only corrected where the phase response is minimum phase.

If the magnitude and phase response of the hearing device is known, the equalization for correcting the ITF could be computed for all portions of the transfer function that are minimum phase. However, in most cases this will not be possible, since there is no analytic way to deal with non-minimum phase regions.

More practically, the desired equalization can be determined through an iterative process. Different minimum phase filtering can be introduced to the hearing device to correct those spectral regions dominated by minimum phase phenomena: in other regions where the phase cannot be corrected, it may be possible to correct the magnitude response. This is done iteratively until a desired phase correction is achieved.

Alternatively, the desired equalization for correcting the ITF magnitude and phase response can be determined subjectively by a user experienced in describing sound. The user compares her perception of sound heard with and without the presence of a hearing device in her ear canal. The desired equalization is achieved when the user indicates that there is no perceived difference between the two conditions.

In accordance with the best mode of the invention the hearing device is configured such that the latency of the sound amplified by the hearing device corresponds to less than about 120 degrees of phase at all frequencies amplified by the hearing device. In other words the latency of the hearing device will preferably be less than about one third of the period of the highest frequency produced by the hearing device. For example, if the device amplifies sounds up to 10 kHz, the preferred latency will be less than 30 μs.

DETAILED DESCRIPTION

Figure 1:
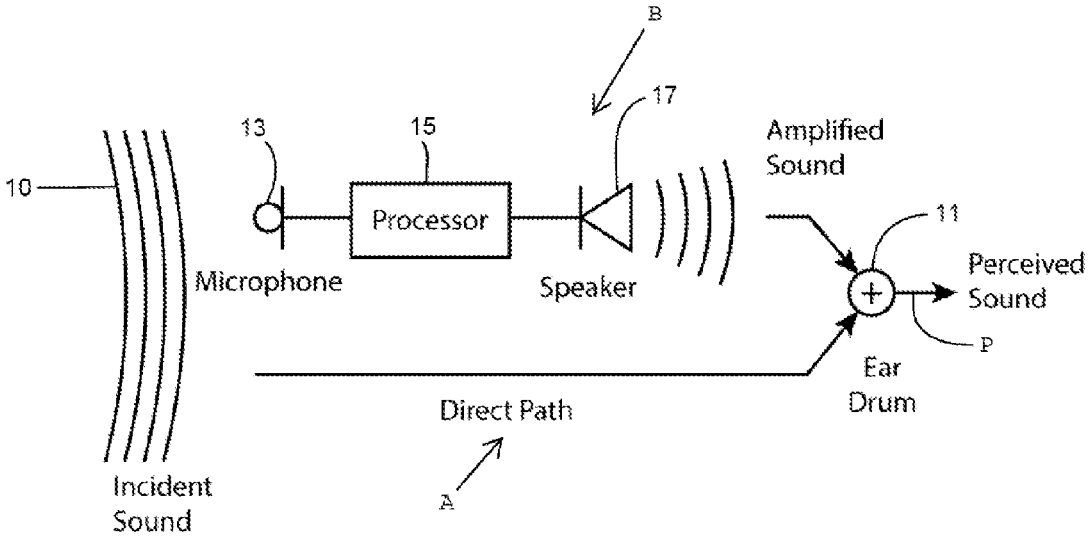
FIG. 1 is a diagrammatic representation an open ear hearing aid worn in the ear where it produces an insertion effect, and showing two sound paths to the ear drum.

The presence of a hearing device in the ear canal changes the transfer function to the ear drum. This change consists of two components: the active response of the device itself, and its passive acoustic effect. If the passive effect is compensated, then the hearing device becomes truly transparent and will sound natural to a user at all sound levels.

For an open type hearing aid, the incident sound is not completely attenuated by the presence of the receiver in the ear canal: this is true because a direct path around the receiver (or loudspeaker) is provided by holes in the rubber insertion tip that holds the receiver in place. Such devices tend to attenuate low frequencies (below 500 Hz) very little, but attenuate higher frequencies in a variable way that depends on the geometry of the hearing aid, the ear tip, and the user's ear canal.

Such an open aid has two advantages for the user: first, for those with high frequency hearing loss (the most common kind), the hearing aid doesn't need to amplify low frequency sounds at all, which places fewer physical constraints on the miniature loudspeaker used. Second, there is no occlusion effect, which is the change in the perception of one's own voice when the entrance to the ear canal is blocked.

For a closed type hearing aid, the incident sound is attenuated at all frequencies and can typically be ignored. This means that the sound produced by the hearing aid is the only significant sound to reach the ear drum. However, the insertion effects remain, in both magnitude and phase, and require correction in the same way described herein.

For a hearing device without a microphone, such as in-ear monitors, the input signal is now an electrical signal. The insertion effect of such devices is identical to the previous case, and can be determined from the case when the sound is played through loudspeakers in front of the wearer.

The method of the invention is first described for the case of an open-ear hearing aid, wherein an acoustic manikin is used for measurements needed to determine the equalization that will be needed to effectively correct for the insertion effects of the hearing aid. Alternatives to using a manikin are later described, namely, the method which does not use a manikin but relies on a live person. The other two cases mentioned above, closed hearing aids and in-ear monitors, are practically identical and can be corrected for using the same method described herein.

An acoustic manikin contains a microphone in an artificial ear that is designed and calibrated to emulate the average human head. The embedded microphone makes it possible to easily measure sound pressure at the ear drum position of the manikin. Such measurements can be used to determine the complex transfer functions that describes how sound passes through the ear to the ear drum, with or without the hearing device in place. Without the hearing device, the ear is unoccluded and the complex transfer function is commonly referred to as the Head Related Transfer Function (HRTF). With the hearing device in place and turned off, the ear is occluded and the complex transfer function can be referred to as the Insertion Transfer function. (ITF). The insertion effect is the difference between the HRTF and the ITF. This is sometimes called "insertion loss", because of the magnitude attenuation associated with it, but the phase is also affected since any resonance or filter that changes magnitude response will necessarily change the phase as well.

The magnitude and phase difference between the HRTF and the ITF must be corrected for transparent perception. The ear canal and the device's insertion effect are static and passive. Thus, their resonances can be described as minimum phase. Minimum phase systems possess several useful properties: their effects are spectrally localized; they have stable inverses; and, for a given magnitude response, the minimum phase response is unique.

All these properties mean that the insertion effect can be removed by adding complementary $2^{nd}$ order, minimum phase filters to the processing in the hearing aid. In doing so, both the magnitude and the phase response will be corrected. If non-minimum phase filters were used, one could correct either the magnitude or the phase response, but never both at once. The transfer function that compensates for the insertion effects will be referred to as the Aided Transfer Function (ATF), and it is identical to the HRTF without the hearing device.

The ATF is the combination, at the ear drum, of the direct sound (described by the ITF) and the amplified sound. For this summation to work properly, the time delay between the sounds must be minimized so that the phase delay corresponds to less than 120 degrees phase at all frequencies amplified by the hearing aid. The phase delay can be adjusted by moving the microphone closer to the hearing aid's receiver and by designing the hearing aid accordingly. Such changes tend to be integral to the design. In contrast, the compensation filters for the ATF can be changed, such as by reprogramming a digital signal processor chip if the hearing aid is digital. (It will be understood that the invention is not limited to a digital implementation.)

To apply this method to a human ear, the in-ear response is measured with a probe microphone. The probe microphone is positioned in the ear canal, and the HRTF, ITF and ATF measured exactly as with an acoustic manikin.

An alternative human application is to take a subjective path: using source material at a level such that the subject can hear it without difficulty, the subject would be asked if source perception without an aid (the HRTF) matches the ATF. With a subject able to provide detailed guidance as to the exact spectral difference between the HRTF and the ATF, one would find the same filters as the measurement methods. This approach works best for trained listeners, such as musicians or recording engineers.

FIG. 1 schematically shows an example of an open ear hearing aid wherein incident sound denoted by the numeral 10 arrives at the ear drum 11 via two sound paths denoted A and B. The direct path A goes around the earpiece (not shown) and is characterized by the Insertion Transfer Function (ITF). The amplified path B goes through the microphone 13, the processor 15 (providing the correction equalization), and the speaker 17. The perceived sound denoted arrow P is the summation of the sound arriving at the ear drum via these two paths.

Figure 2:
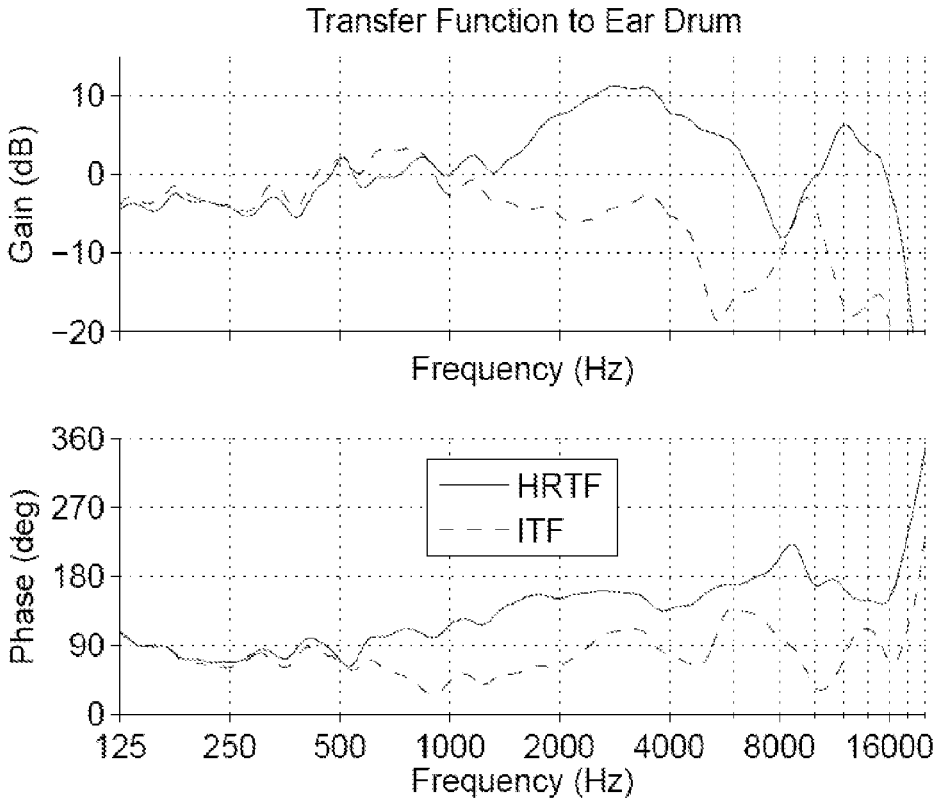
FIG. 2 are graphs that show the insertion effects of an open ear hearing device where the head related transfer function (HRTF) and insertion transfer function (ITF) were measured on an acoustic manikin. (Magnitude response is shown on the upper graph, and phase response is shown on the lower graph.)

An example of an insertion effect from an open ear hearing aid is shown in FIG. 2, which shows transfer function measurements from an acoustic manikin. The insertion effect is the difference between the HRTF and the ITF: as shown in the top graph, the magnitude is different from 500 Hz and above ("insertion loss"); as shown in the bottom graph, the phase differs above 500 Hz.

Figure 3:
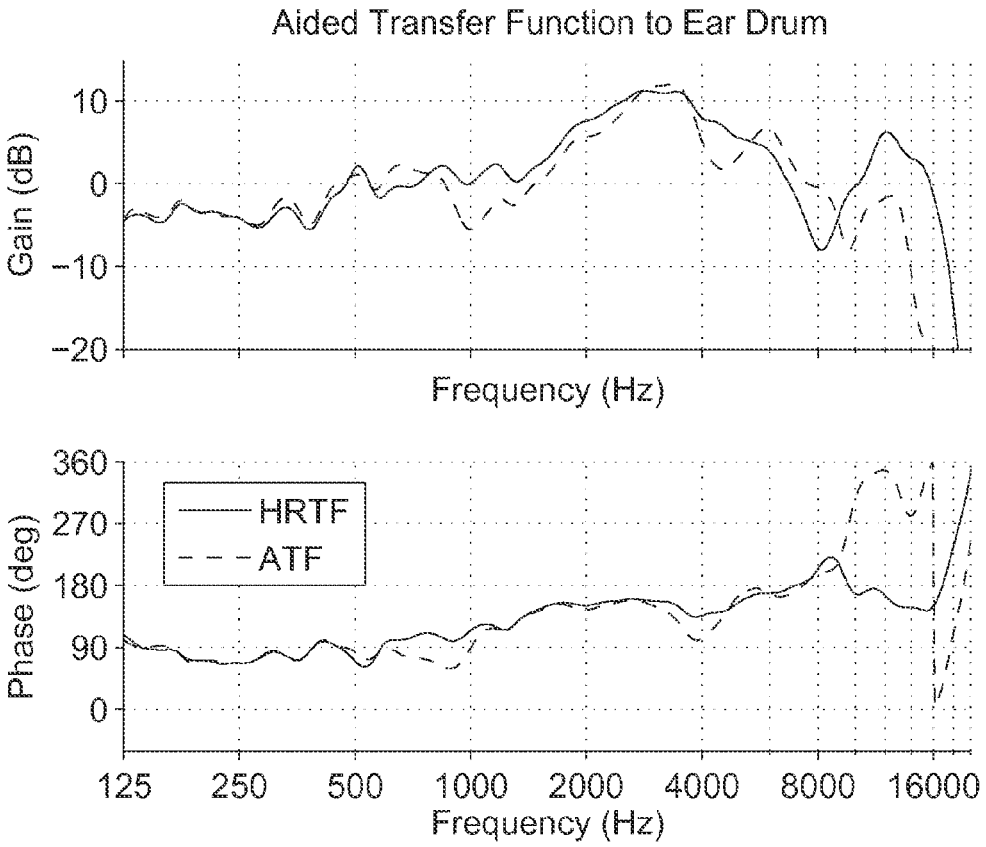
FIG. 3 are graphs that show how the ITF can be compensated with $2^{nd}$ order minimum phase filters in accordance with the invention. The HRTF is identical to FIG. 2, while the aided transfer function (ATF) is the result of the direct sound and the sound amplified and equalized by the hearing device. (Magnitude response is shown on the upper plot, phase response on the lower.) HRTF is the head related transfer function and ATF is the aided transfer function.

The insertion effect is shown corrected using $2^{nd}$ order minimum phase filters in FIG. 3. It is noted that the difference between the ATF and the HRTF is considerably less over the range of 1-8 kHz in magnitude and phase. The small dip at 950 Hz is not a minimum phase resonance.

Figure 4A:
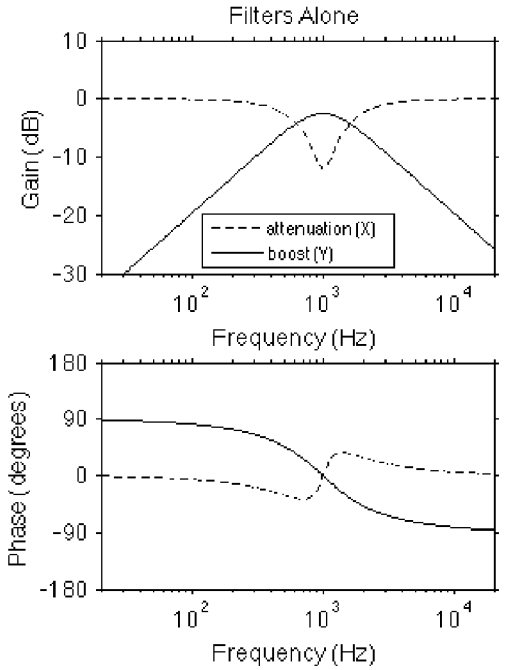
FIGS. 4A and 4B are graphs that mathematically demonstrate how a minimum phase filter can completely compensate for attenuation, in analogy to FIG. 3. (Magnitude response is shown above; phase response is shown below.) The filters are shown separately in FIG. 4A and are shown summed together in FIG. 4B.
Figure 4B:
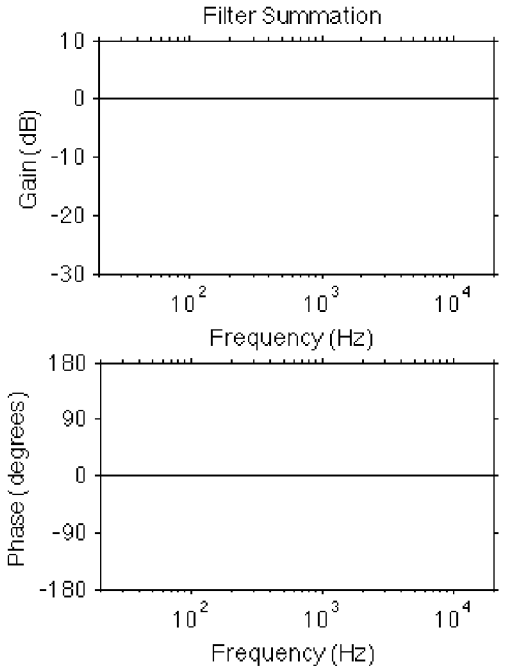

This concept is shown mathematically for the case of minimum phase filters in FIGS. 4A and 4B. It is also true in general for any causal filter having a stable inverse. For this embodiment, the direct sound attenuated by the hearing aid (the ITF) is modeled as a bell-shaped attenuating filter ("attenuation"), which has a minimum at the center frequency and approaches unity away from the center. Mathematically, that $2^{nd}$ order minimum phase filter is given by the biquadratic equation $$\frac{s^2 + \frac{W}{Q_{cut}}s + W^2}{s^2 + \frac{G_{cut}W}{Q_{cut}}s + W^2}$$

where s is the Laplace variable, W is the angular frequency (=2πF, where F is the center frequency), Q is the quality factor, and G is the gain, restricted in this case to be greater than one. This filter's transfer function is plotted as the dashed lines in FIG. 4A.

The hearing aid's response ("boost") is modeled as a bandpass filter with gain, which has a magnitude maximum at the center frequency and approaches zero at the edges:

$$\frac{\frac{G_{boost}W}{Q_{boost}}s}{s^2 + \frac{W}{Q_{boost}}s + W^2}$$

Their summation at the ear drum corresponds to the ATF. It can be shown analytically, given a fixed attenuation filter, that a boost with the parameters $$G_{boost} = 1 - \frac{1}{G_{cut}}$$

$$Q_{boost} = \frac{Q_{cut}}{G_{cut}}$$

results in unity magnitude and zero phase response a shown in FIG. 4B. The filter parameters in FIGS. 4A and 4B were chosen according to such a relationship. Such a system is completely transparent.

Note that this embodiment corresponds to filters that sum in parallel. When two filters are placed in series, one acting on the output of the other, they sum to unity under much simpler conditions, namely when the filters are inverses of each other. The mathematical argument outlined above is a specific case, and can be shown to hold for many other filter combinations: two bell-shaped filters (two biquads), a high pass and a low pass, etc.

The example above assumes no time delay between the direct and the amplified sound. Thus, they sum coherently the ear drum because there is no phase shift at the peak frequency and negligible phase shift at surrounding frequencies. Such a condition is met when the hearing aid has no latency and there is no appreciable distance (or propagation time) between the microphone and the hearing aid.

If the amplified sound is delayed sufficiently, there will be a frequency where the phase is shifted by 180° with respect to the direct sound. When summing at the ear drum, such sounds will sum destructively with each other and cancel. The relative magnitude of the amplified to the direct sound at a given frequency determines whether the cancellation will be complete (equal magnitudes) or partial (unequal magnitudes).

Figure 5A:
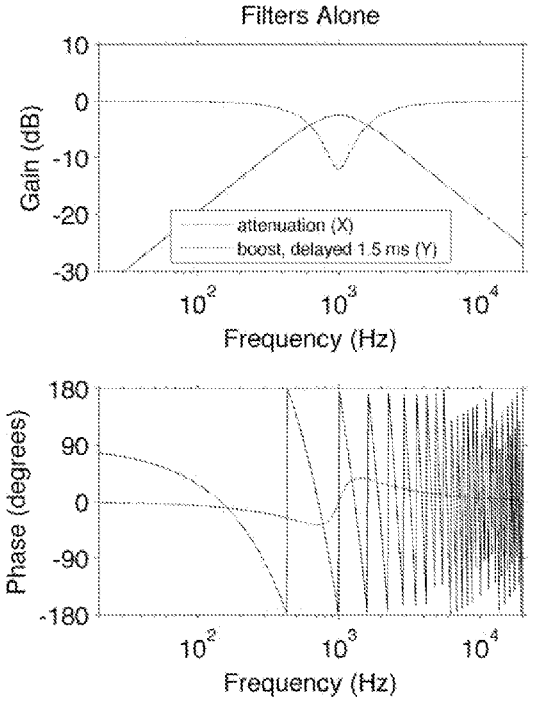
FIGS. 5A and 5B are graphs that mathematically demonstrate how a bandpass filter delayed by 1.5 ms prevents compensation of an attenuation (magnitude and phase). Again, the filters are shown separately in FIG. 5A and are shown summed together in FIG. 5B.
Figure 5B:
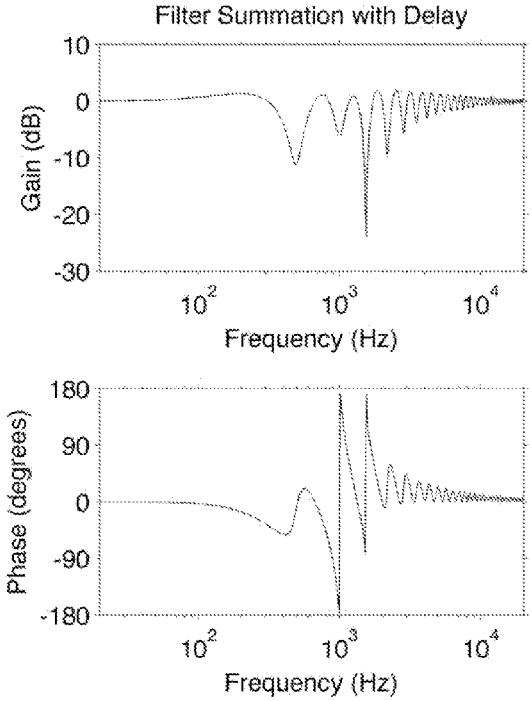

Most hearing aids, have latencies of at least 1.5 ms, if not longer, which results in significant cancellation and prevents proper compensation of the ITF. Such a case is modeled by adding pure delay to a bandpass filter; delay has a linear phase response, as shown in FIGS. 5A and 5B. For a delay of 1.5 ms, there are two noticeable effects: 1) the magnitude response at the center frequency is less than the amplified sound alone, and 2) there is extensive combing around the center frequency. The comb filtering includes several notches with a gain less than −10 dB, which distort the input signal significantly.

The microphone delay can be reduced by shortening the separation distance between microphone and receiver; it can be increased by adding delay in the processing circuitry (which is presumably, but not necessarily, a digital processor) or by moving the microphone further away from the receiver.

While the present invention has been described in considerable detail in the foregoing specification, it will be understood it is not intended that the invention be limited to such detail, except as necessitated by the following claims.

We claim:

1. A method of correcting magnitude and phase distortion in hearing devices wherein at least a portion of the hearing device is inserted in the ear when worn by the user, comprising determining the insertion effect of the hearing device when in the ear of a user, wherein the insertion effect is characterized by a complex insertion transfer function (ITF) having a magnitude and a phase response, correcting for said insertion effect by correcting both the magnitude and phase response of the ITF, wherein the phase response is only corrected where the phase response is minimum phase.

2. The method of claim 1 wherein the insertion effect is corrected by at least one $2^{nd}$ order minimum phase filter.

3. The method of claim 2 wherein said $2^{nd}$ order minimum phase filter is an infinite impulse response (IIR) filter.

4. The method of claim 2 wherein said $2^{nd}$ order minimum phase filter is a biquad filter.

5. The method of claim 1 wherein the insertion effect is corrected by a plurality of $2^{nd}$ order minimum phase filters.

6. The method of claim 5 wherein said plurality of $2^{nd}$ order minimum phase filters are infinite impulse response (IIR) filters.

7. The method of claim 5 wherein said plurality of $2^{nd}$ order minimum phase filters are biquad filters.

8. The method of claim 1 wherein the passage of sound through the ear to the ear drum without the hearing device in the ear is characterized by a complex head-related transfer function (HRTF), and wherein the step of correcting for said insertion effect includes determining a desired equalization for correcting the ITF magnitude and phase response, said equalization being determined from the complex head-related transfer function (HRTF) and the complex insertion transfer function (ITF), wherein the magnitude and phase of the desired equalization is the ratio of the HRTF to the ITF.

9. The method of claim 8 wherein the complex HRTF is determined by measuring the complex HRTF of a manikin.

10. The method of claim 8 wherein the complex HRTF is determined by measuring the complex HRTF of a user of the hearing device.

11. The method of claim 8 wherein the complex ITF is determined by measuring the complex ITF of the hearing device on the ear of a manikin.

12. The method of claim 8 wherein the complex ITF is determined by measuring the complex ITF of the hearing device when worn by a user.

13. The method of claim 1 wherein the step of correcting for said insertion effect includes determining a desired equalization for correcting the ITF magnitude and phase response, wherein the desired equalization is determined subjectively by a user experienced in describing sound, wherein the user compares sound heard without the hearing device with substantially the same sound heard when wearing the hearing device, wherein the desired equalization is achieved when there is no perceived difference between the two.

14. The method of claim 8 wherein, if the magnitude and phase response of the hearing device is known, the equalization for correcting for the magnitude and phase response is computed for all portions of the phase response that are minimum phase.

15. The method of claim 8 wherein different minimum phase filtering is iteratively introduced to the hearing device where the phase response is minimum phase until a desired phase correction is achieved.

16. The method of claim 1 wherein the hearing device amplifies sound within the audio frequency spectrum, and wherein the hearing device is configured such that the latency of the amplified sound corresponds to less than about 120 degrees phase of the highest frequency produced by the hearing device.

17. The method of claim 1 wherein the latency of the hearing device is less than about one third of the period of the highest frequency produced by the hearing device.

18. A method of correcting magnitude and phase distortion in hearing devices wherein at least a portion of the hearing device is inserted in the ear when worn by the user, wherein when worn the hearing device produces an insertion effect characterized by a complex insertion transfer function (ITF) having a magnitude and phase response, said method comprising configuring the hearing device such that the latency of the hearing device when worn is less than about one third of the period of the highest frequency amplified by the hearing device, correcting for the magnitude response of the complex ITF, and correcting for the phase response of the complex ITF wherever the phase response is minimum phase.

19. The method of claim 18 wherein the magnitude and phase response of the complex ITF are corrected using a least one minimum phase $2^{nd}$ order filter.

20. The method of claim 19 wherein said minimum phase $2^{nd}$ order filter is an infinite impulse response (IIR) filter.

21. The method of claim 19 wherein said minimum phase $2^{nd}$ order filter is a biquad filter.

22. The method of claim 18 wherein the latency of the hearing device produces frequency dependent phase delay of the sound passing through the device, and wherein, if the ITF phase response and frequency dependent phase delays are known, the phase correction is computed for all portions of the phase response that are minimum phase.

23. The method of claim 18 wherein different minimum phase filtering is iteratively introduced to the hearing device where the phase response is minimum phase until a desired phase correction is achieved.

24. A hearing device for producing amplified sound in one or more selected frequency bands, wherein at least a portion of the hearing device is inserted in the ear when worn by the user, said hearing device comprising a microphone, a speaker insertable in the ear, wherein the distance between the microphone and speaker is chosen such that the latency of the hearing device, when worn, is less than about one third of the period of the highest frequency amplified by the hearing device, and a processor between the microphone and speaker, wherein at least the speaker of the hearing device creates an insertion effect when inserted in the ear, the insertion effect being characterized by a complex insertion transfer function (ITF) having a magnitude and a phase response, and wherein said processor is configured to correct for the insertion effect by correcting both the magnitude and phase response of the ITF, the phase response being corrected only where the phase response is minimum phase.

25. The hearing device of claim 24 wherein said processor includes at least one minimum phase $2^{nd}$ order filter, and wherein said minimum phase $2^{nd}$ order filter is used to correct the magnitude and phase response of the complex ITF.

26. The hearing device of claim 25 wherein said minimum phase $2^{nd}$ order filter is an infinite impulse response (IIR) filter.

27. The hearing device of claim 25 wherein said minimum phase $2^{nd}$ order filter is a biquad filter.

* * * * *